US008927837B1

(12) United States Patent
Gallop

(10) Patent No.: US 8,927,837 B1
(45) Date of Patent: Jan. 6, 2015

(54) DECORATIVE GUITAR TAILPIECE COVER

(71) Applicant: Neal Gallop, Havertown, PA (US)

(72) Inventor: Neal Gallop, Havertown, PA (US)

( * ) Notice: Subject to any disclaimer, the term of this patent is extended or adjusted under 35 U.S.C. 154(b) by 0 days.

(21) Appl. No.: 13/950,166

(22) Filed: Jul. 24, 2013

(51) Int. Cl.
*G10D 3/00* (2006.01)
*G10D 3/12* (2006.01)

(52) U.S. Cl.
CPC ..... *G10D 3/12* (2013.01)
USPC ..... 84/299

(58) Field of Classification Search
USPC ..... 84/267, 290, 299, 300–302
See application file for complete search history.

(56) References Cited

U.S. PATENT DOCUMENTS

| | | | | |
|---|---|---|---|---|
| 1,713,855 | A * | 5/1929 | Oettinger | 84/300 |
| 5,517,891 | A * | 5/1996 | Sica | 84/453 |
| 7,459,618 | B2 | 12/2008 | Kim et al. | |
| 7,635,809 | B2 * | 12/2009 | Higgs et al. | 84/327 |

* cited by examiner

*Primary Examiner* — Kimberly Lockett
(74) *Attorney, Agent, or Firm* — Jerome E Sacks

(57) ABSTRACT

Presented is a decorative cover that replaces the bar of a standard tailpiece of a stringed musical instrument such as a guitar. The decorative cover is attractive and hides the retaining screws used to attach the bar. The decorated cover component may be manufactured in a wide range of designs to appeal to various and diverse groups of guitarists, and accommodates shapes that are not found in prior art guitars such as steer heads, crosses, and annular disks.

5 Claims, 6 Drawing Sheets

DECORATIVE GUITAR TAILPIECE COVER

CROSS-REFERENCE TO RELATED APPLICATIONS

This application claims the benefit of the U.S. Provisional Patent Application No. 61/679,685 filed Aug. 4, 2012 by the present inventor. This provisional patent application is incorporated herein by reference.

TECHNICAL FIELD

This invention relates to tailpieces for stringed musical instruments, such as guitars, bass guitars, electric upright basses, electric violins, electric mandolins, and the like.

BACKGROUND OF THE DISCLOSURE

There exists many tailpiece designs in the guitar world. Many are designed to lock into place, be integrated with the bridge, or serve some other useful or musical purpose. However, there is a lack of tailpiece designs that allow the tailpiece to be decorative and appeal to a guitar owner's taste and interest. The inventive concept presented herein overcomes these limitations by allowing the decorative cover to replace the prior art tailpiece by accommodating a wide variety of shapes.

SUMMARY OF THE DISCLOSURE

The embodiments of the inventive concept presented herein is comprised of a decorative cover that is adapted to replace the existing guitar bar of a guitar. The decorative cover design is different from prior art guitar bars, (i.e. has a nonstandard profile) and is appealing to the user. The decorative cover replaces the guitar bar and hides the guitar bar's retaining screws. It is attached to the guitar by having grooves that slide onto the retaining screws, and has string anchoring slots similar to those found on the discarded guitar bar. Depending on the decorative cover's shape, the grooves and string anchoring slots are configured and positioned on the guitar cover in a manner that accommodates the decorative cover's installation on the retaining screws and the installation of the strings on the decorative cover. The inventive concept applies to other stringed musical instruments. What is novel about the inventive concept presented herein is that the decorative cover, when replacing the guitar bar of a guitar, preserves the functionality of the guitar bar but allows the decorative cover to have a distinctive and appealing shape.

PART NUMBERS

Figure 2:
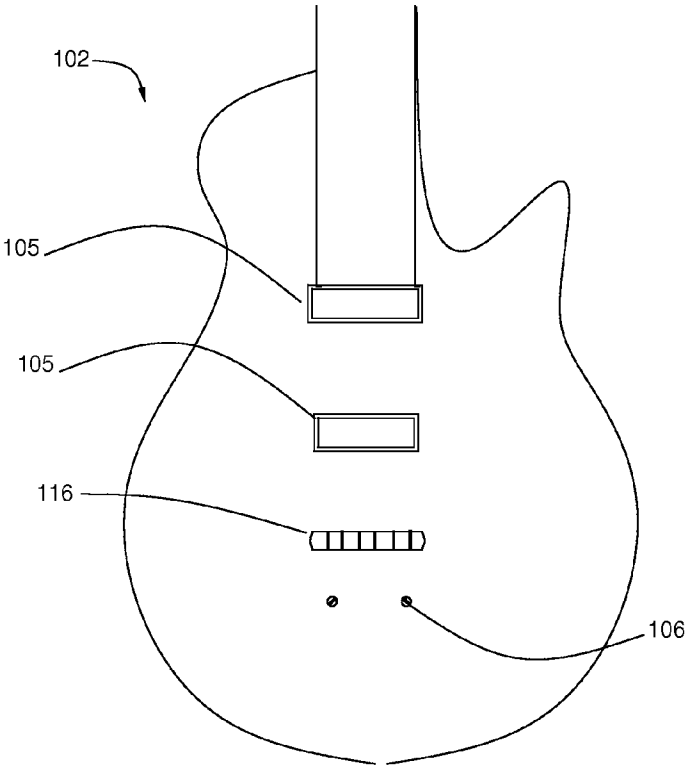
(Prior Art) Fig. 2
FIG. 2 illustrates a top view of the prior art guitar, without the strings and guitar bar.

Number/Name
102 prior art guitar
103 guitar body
104 guitar bar
105 pickup
106 retaining screw
107 string
108 string end ball
109 string anchoring slot
110 string anchoring slot extension
111 screw holes
112 groove arc
114 tailpiece
116 bridge
117 decorative cover
119 screw slot
120 screw threads
121 groove
122 width
123 right groove
124 bar slit
126 second decorative cover
130 screw head
132 third decorative cover

DETAILED DESCRIPTION OF THE DISCLOSURE

Figure 1:
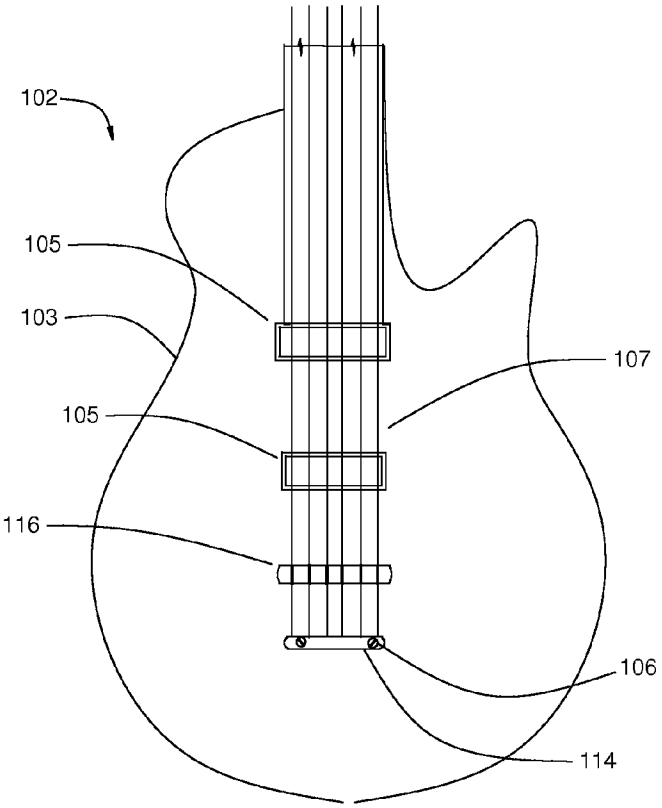
(Prior Art) Fig. 1
FIG. 1 illustrates a top view of a prior art guitar.

In the following detailed description, the three embodiments presented apply to guitars. However the inventive concept applies to other musical instruments with the terms guitar and guitar bar replaced by stringed musical instrument and string musical instrument bar. The term tailpiece refers to a guitar bar and its retaining screws. The decorative cover is adapted to a particular prior art guitar. The terms left, right, top, bottom and similar adjectives applies to the figure they refer to. If more than one part having the same functionality is present on a figure, only one of the parts may have a numeral. The strings are "properly installed" on the string anchoring slots on a decorative cover, if when the decorative cover is installed on the guitar, the guitar may be tuned so that it is playable. A decorative cover has a visible side, which is viewable when installed on a guitar and a hidden side which faces the guitar body. A guitar bar or decorative cover is defined to have a standard profile if its shape resembles that of the guitar bar of a prior art guitar. The three embodiments presented herein are examples of decorative covers that do not have a standard profile FIG. 1 illustrates a top view of a prior art guitar 102. It has a guitar body 103, two pickups 105, a bridge 116, two retaining screws 106, six strings 107, and a guitar bar 104.

FIG. 2 illustrates a top view of the prior art guitar 102 without the strings or guitar bar, but does has the two retaining screws 106.

Figure 3:
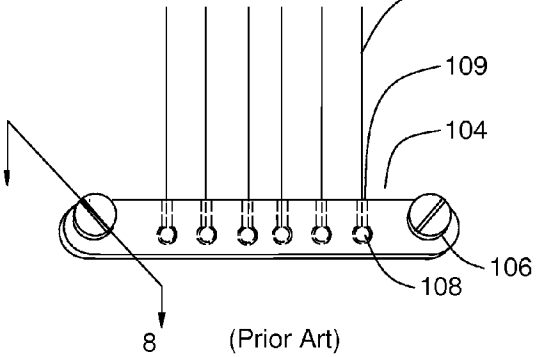
(Prior Art) Fig. 3
FIG. 3 is a perspective view of the guitar bar of prior art guitar with the strings attached.

FIG. 3 illustrates a top perspective view of the prior art guitar bar with six strings 107 attached. Guitar bar 104 has six string anchoring slots 109, each anchoring slot having a spherical cavity at the bottom that receive the string end balls 108. Also illustrated are two retaining screws 106.

Figure 4:
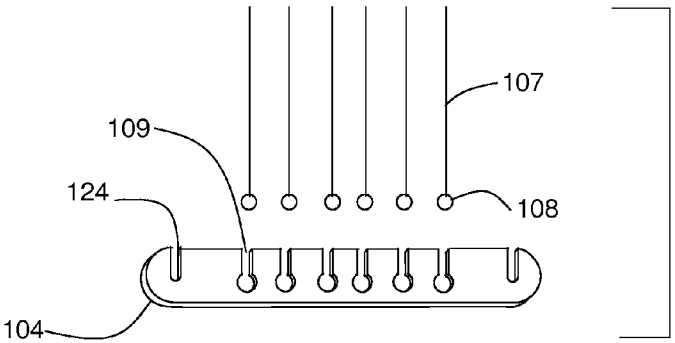
(Prior Art) Fig. 4
FIG. 4 is a bottom exploded perspective view of the guitar bar of prior art guitar with the strings ready to be attached.

FIG. 4 is a bottom perspective exploded view of guitar bar 104 with strings 107 and string end balls 108 ready to be attached. Guitar bar 104 has two bar slits 124 that are matched to screw slots 119 (illustrated in FIG. 5) so that bar slits 124 fit snugly in screw slots 119.

Figure 5:
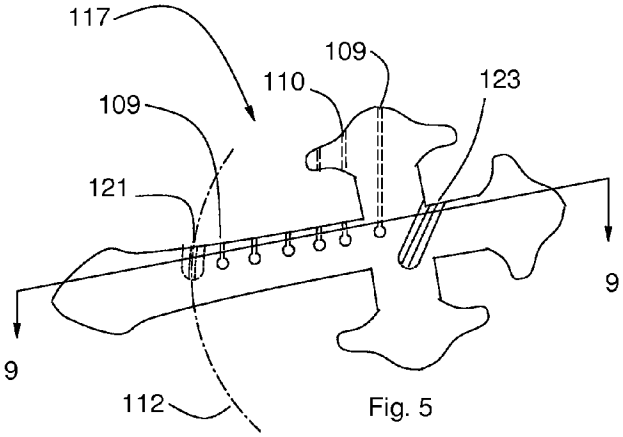
FIG. 5 is a top view of the cover component of the first embodiment of the present invention.
Figure 7:
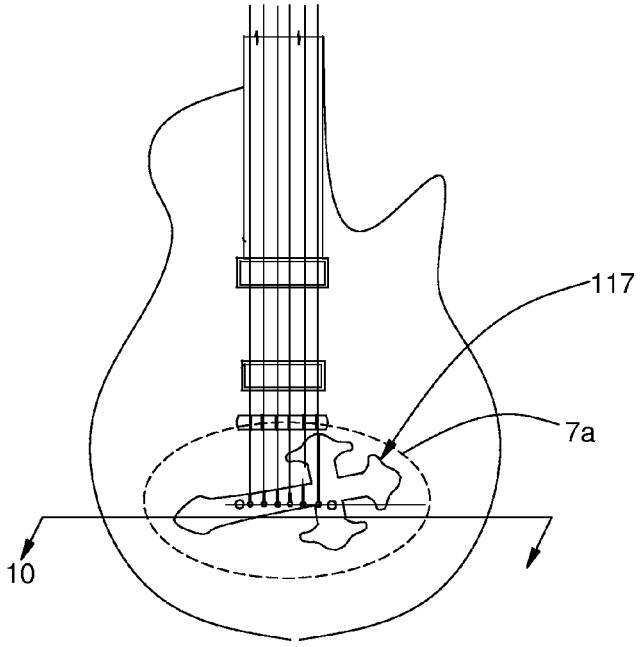
FIG. 7 illustrates a front view of the first embodiment of the present invention.
Figure 7A:
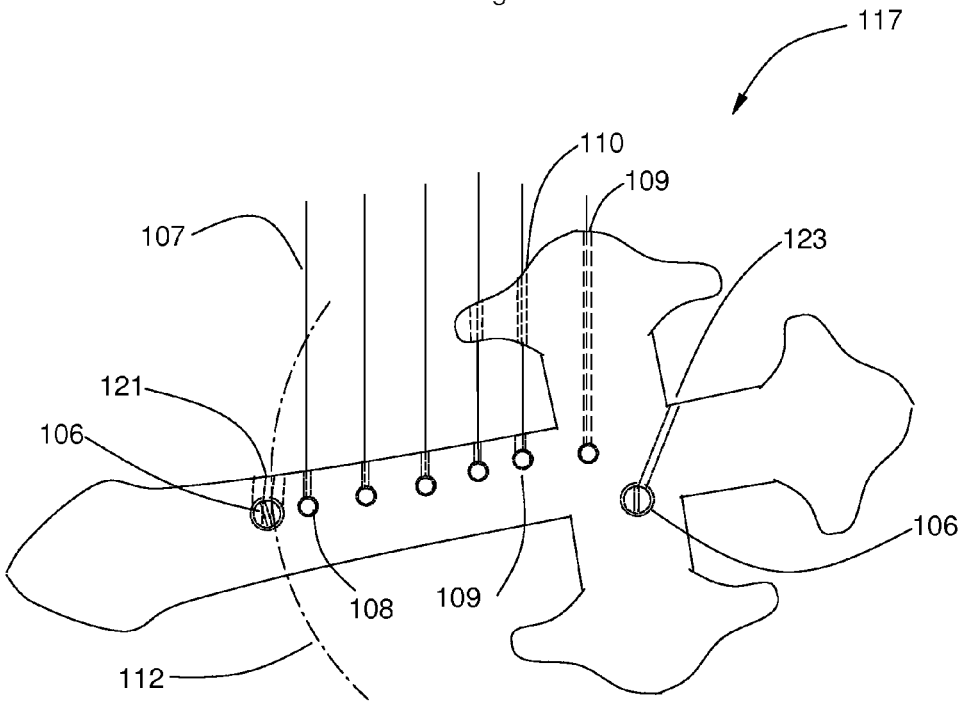
FIG. 7*a* is a detail of FIG. 7 in an expanded scale.
Figure 9:
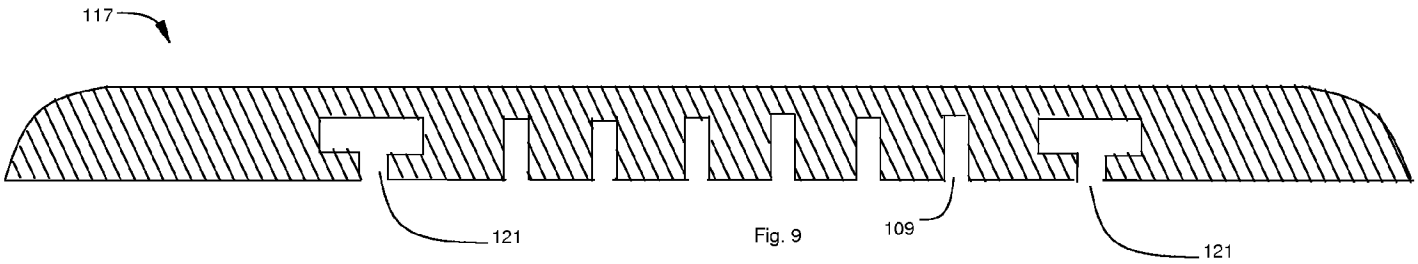
FIG. 9 is sectional view of the decorative cover of the first embodiment of the present invention.
Figure 10:
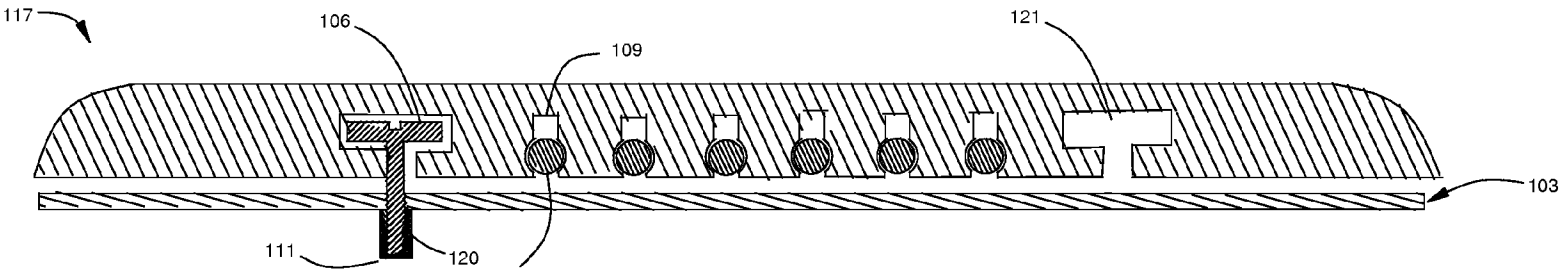
FIG. 10 is a sectional view of the decorative cover installed on the guitar of the first embodiment of the present invention.

FIG. 5 is a top view of decorative cover 117 of the first embodiment of the present invention. Decorative cover 117 has an unusual shape, and is intended to be installed on a guitar with the longitudinal axis of the decorative cover not at right angles to the strings as illustrated in FIG. 7. FIG. 7 is a front view illustrating the decorative cover 117 installed on a guitar as intended, and FIG. 7*a* illustrates details of FIG. 7 in an expanded scale. FIG. 10 is a sectional view of decorative cover 117 installed on retaining screws 106. Referring to FIGS. 5 and 7 and 7*a*, decorative cover 117 has two grooves 121 and 123 that are matched to screw slots 119 of retaining screws 106 so that decorative cover 117 can fit snugly on retaining screws 106. FIG. 9 illustrates a cross-section of the shape of groove 121, the cross section taken perpendicular to the longitudinal axis of the groove 121. The grooves and screw slots on decorative cover 117 are designed and configured so that when the decorative cover 117 is installed on the guitar using the screw slots, a tight fit holds them securely in place while allowing the six strings 107 with string end balls 108 to be properly installed in string anchoring slots 109 in the same manner that a prior art guitar bar such as guitar bar 104 installs the strings. Note that there are two string anchoring slot extensions 110 that accommodate two strings, and that the decorative cover hides the retaining screws when installed on the guitar. Note also that groove 121 has sides that are curved, the curve having the shape of an arc with each arc concentric with groove arc 112 which has its arc center located near the bottom of right groove 123.

Figure 6:
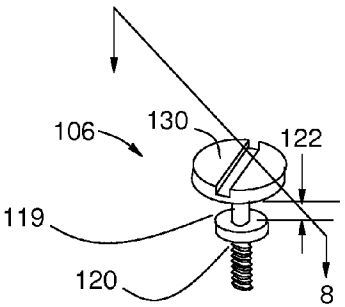
(Prior Art) Fig. 6
FIG. 6 is a perspective view of the retaining screw of the prior art guitar.

FIG. 6 illustrates a perspective view of a retaining screw 106. Retaining screw 106 has a screw head 130, has a screw slot 119 with a width 122. Screw slot 119 is adapted to the grooves 121 positioned on the decorative cover 117 so that decorative cover 117 slides onto retaining screws 106 in the same manner that guitar bar 104 did.

FIG. 7 illustrates a top view of decorative cover 117 installed on the guitar, replacing the guitar bar 104.

FIG. 7*a* is a top, detailed view in expanded scale of FIG. 7 of decorative cover 117 of the first embodiment. FIG. 7*a* illustrates the strings 107 with string end balls 108, and the groove 121 installed on the retaining screws 106. The important thing to note is that the two retaining screw lie along an axis perpendicular to the installed strings 107, but the length of the grooves may vary from groove to groove to accommodate the positioning of the decorative cover 117 on the guitar. In particular the string anchoring slot 109 on the right of the figure has a length considerably longer than the other string anchoring slots. Note also the right groove 123 in FIG. 7*a* is not parallel to the strings when installed. This never occurs in a prior art guitar bar. Right groove 123 is so positioned to keep the length of this groove small and left groove 121 has sides curved as described above. However other configurations and positioning of the grooves and string anchoring slots may be implemented.

Installation of decorative cover 117 is as follows. 1) Insert the six strings in the six string anchoring slots 109. 2) Slide the right groove 123 onto right retaining screw 106. 3) Slide the left groove 121 onto left retaining screw 106. The curved sides of left groove 121 facilitate this step since the decorative cover 117 will rotate slightly during step 3.

Figure 8:
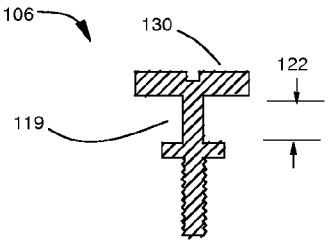
FIG. 8 is a sectional of the retaining screw of the prior art guitar.

FIGS. 8 through 10 present three sectional views illustrating the decorative cover 117. FIG. 8 is a sectional view of a restraining screw 106. FIG. 9 illustrates a sectional view of the decorative cover 117. FIG. 10 illustrates a sectional view of decorative cover 117 installed on the two retaining screws 106 of the first embodiment of the present invention. Also illustrated in FIG. 10 are the string end balls 108 and guitar body 103.

Figure 11:
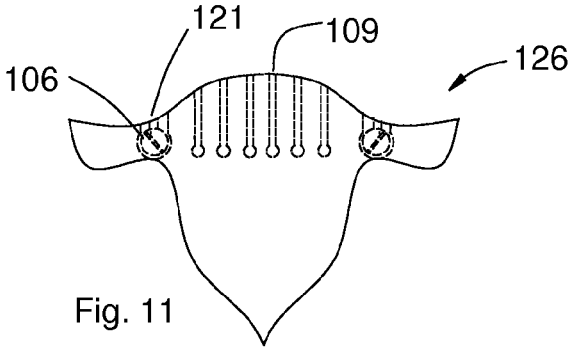
FIGS. 11 and 12 illustrate a second embodiment of the present invention.
Figure 12:
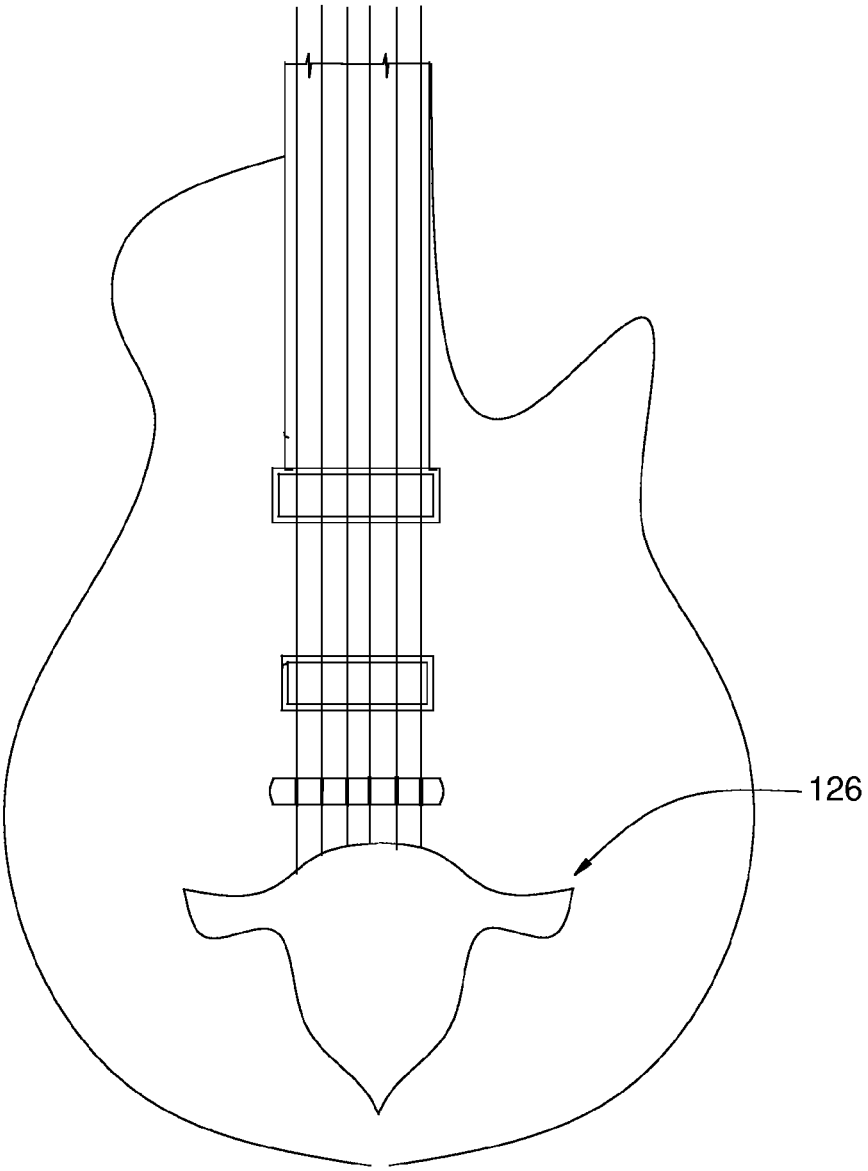
Figure 13:
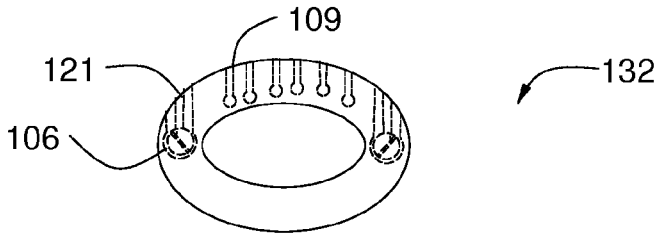
FIGS. 13 and 14 illustrate a third embodiment of the present invention.
Figure 14:
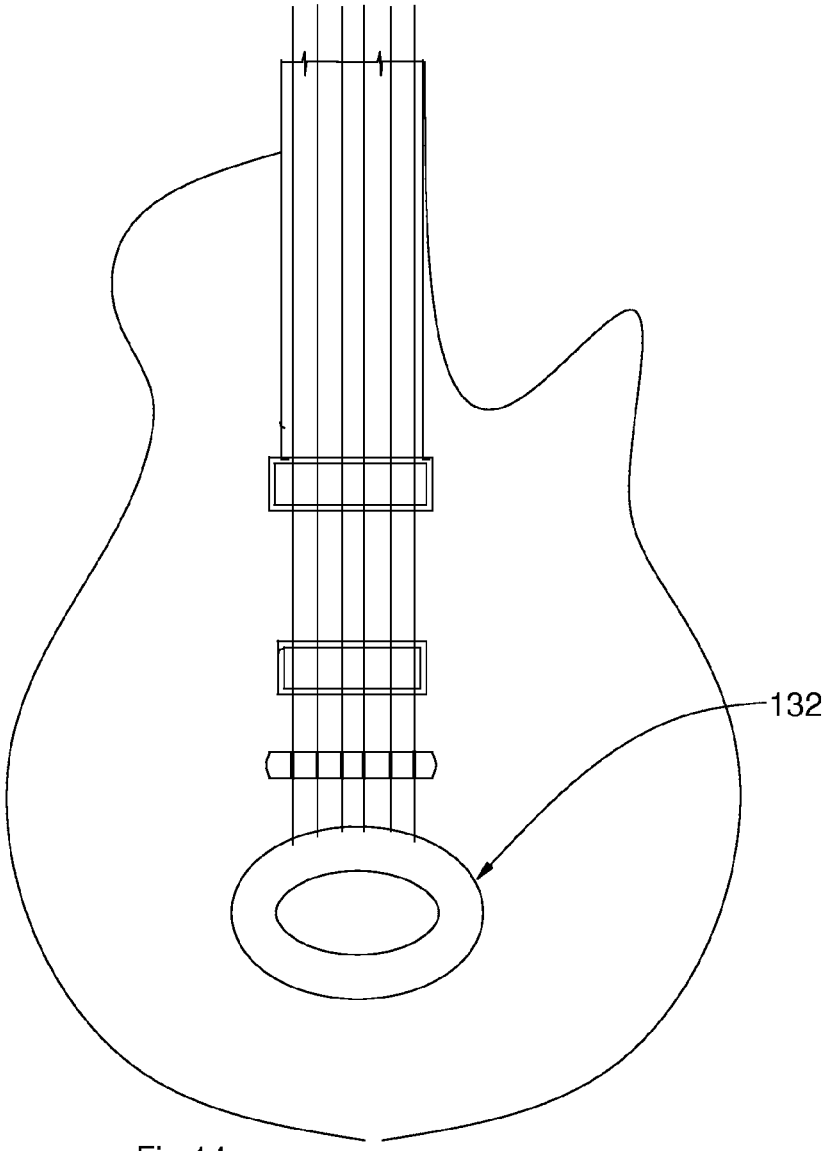

FIG. 11 illustrates a second decorative cover 126, a second embodiment of the present invention having the profile of a steer head; the decorative cover 126 does not have a standard profile. FIG. 12 illustrates a second decorative cover 126 installed on a guitar FIG. 13 illustrates a third decorative cover 132, a third embodiment of the present invention having the profile of an oval annular disk; the decorative cover 132 does not have standard profile. FIG. 14 illustrates third decorative cover 132 installed on the guitar.

Note that the three decorative covers 117, 126 and 132 all hide the retaining screws when installed. The string anchoring slots 109 may have various lengths (see FIG. 11), various angles relative to the strings (see FIG. 7*a*), staggered horizontal alignments relative to each other (see FIG. 13), and the string slots may be curved (see FIG. 5). These features differ from a typical prior art guitar bar (see FIG. 3).

The decorative cover may be constructed from a variety of materials sufficiently rigid to accommodate the tension of the strings on the guitar, such as those known in the art and traditionally used in stringed musical instruments, including metals (e.g., brass, steel, aluminum, alloys, and the like), natural materials (e.g., bone, ivory, wood, and the like), and synthetic or composite materials (tusq, resin, plastic, and the like).

When the inventive concept presented herein is commercialized, it typically will be produced to match a particular class of commercial guitars that have compatible tailpiece installation configurations.

The disclosure presented herein gives multiple embodiments of the present invention. These embodiments are to be considered as only illustrative of the invention and not a limitation of the scope of the present invention. Various permutations, combinations, variations, and extensions of these embodiments are considered to fall within the scope of this invention.

What is claimed is:

1. A decorative cover for a stringed musical instrument, said decorative cover not having a standard profile, said stringed musical instrument having two retaining screws used for attaching a stringed musical instrument bar, said stringed musical instrument bar capable of securing a plurality of strings;

said decorative cover comprising:

two grooves that enable the decorative cover to be installed on said two retaining screws such that said two retaining screws are hidden;

a plurality of string anchoring slots that allow said plurality of strings to be attached to said decorative cover;

wherein said plurality of strings are properly installed on said decorative cover using said plurality of string anchoring slots, and said decorative cover is installed on said stringed musical instrument, then said guitar is playable if tuned properly.

2. The decorative cover of claim 1, wherein said stringed musical instrument is selected from the group consisting of a guitar, a bass guitar, an electric upright bass, an electric violin, and an electric mandolin.

3. The decorative cover of claim 1 wherein said decorative cover is adapted to replace said stringed musical instrument bar of a commercially available stringed musical instrument.

4. A decorative cover for a guitar, said decorative cover not having a standard profile;

said guitar having two retaining screws used for attaching a guitar bar, said guitar bar capable of securing a plurality of strings;

said decorative cover having two grooves and a plurality of string anchoring slots wherein said two grooves enable said decorative cover to be installed on said two retaining screws while hiding said two retaining screws, and said plurality of string anchoring slots being configured so that when the decorative cover is installed on said two retaining screws, said plurality of string anchoring slots can accommodate an installation of the plurality of strings on said guitar.

5. A method for constructing a decorative cover for a guitar having two retaining screws and a plurality of strings, said method comprising the steps of:

a. selecting a prior art guitar;

b. selecting a decorative cover design, said decorative cover design not having a standard profile, said decorative cover design having a visible side and a hidden side, said decorative cover design sized so that it covers said two retaining screws;

c. manufacturing said decorative cover to conform to said decorative cover design, said decorative cover having said visible side and said hidden side, said decorative cover incorporating two grooves and a plurality of string anchoring slots wherein said two grooves installed on said hidden side said plurality of string anchoring slots installed on said hidden side;

wherein said plurality of strings are installed on said plurality of string anchoring slots and said decorative cover installed on said two retaining screws, then said plurality of strings are properly installed on said guitar.

* * * * *